US006085863A

United States Patent [19]

Shuen

[11] Patent Number: 6,085,863

[45] Date of Patent: Jul. 11, 2000

[54] EXHAUSTION PIPE STRUCTURE

[75] Inventor: Shun Tian Shuen, San Chung, Taiwan

[73] Assignee: Janchy Enterprise Co., Ltd., San Chung, Taiwan

[21] Appl. No.: 09/325,378

[22] Filed: Jun. 4, 1999

[51] Int. Cl.[7] ..... F01N 7/08

[52] U.S. Cl. ..... 181/228; 181/227; 181/239; D12/194

[58] Field of Search ..... 181/228, 227, 181/239, 241; D12/194

[56] References Cited

U.S. PATENT DOCUMENTS

| | | | |
|---|---|---|---|
| D. 133,788 | 9/1942 | Koch | D12/194 |
| D. 189,573 | 1/1961 | Russell | D12/194 |
| D. 191,509 | 10/1961 | Feinberg | D12/194 |
| D. 413,296 | 8/1999 | Hussaini | D12/194 |
| 2,630,835 | 3/1953 | Russell | 138/46.5 |
| 6,006,859 | 12/1999 | Hussaini | 181/227 |

*Primary Examiner*—Bentsu Ro
*Assistant Examiner*—Edgardo San Martin
*Attorney, Agent, or Firm*—Bacon & Thomas, PLLC

[57] ABSTRACT

An exhaustion pipe structure including a hollow tube body, a fitting ring, locking plates, locking screws, an exhaustion fitting pipe and a decoration. The decoration is replaceably fitted with the hollow tube body which is fitted around the exhaustion pipe of a car so as to beautify the exhaustion pipe.

1 Claim, 3 Drawing Sheets

EXHAUSTION PIPE STRUCTURE

BACKGROUND OF THE INVENTION

The present invention relates to an exhaustion pipe structure which is equipped with a decoration and fitted around the exhaustion pipe of a car so as to beautify the exhaustion pipe. The decoration is replaceable according to the desire of a user.

It is known that a car is often decorated or equipped with various components. For example, the exhaustion pipe of a car is often such decorated as to have different color or equipped with an insulating material. However, the conventional exhaustion pipe still has many shortcomings in appearance. For example, the conventional exhaustion pipe structure of a car is often changed in diameter or colorfully painted to beautify the appearance. However, such change still fails to provide a highlighting decorative effect for the exhaustion pipe.

SUMMARY OF THE INVENTION

It is therefore a primary object of the present invention to provide an exhaustion pipe structure for beautifying and highlighting the exhaustion pipe of a car. The exhaustion pipe structure includes a hollow tube body, a fitting ring, locking plates, locking screws, an exhaustion fitting pipe and a decoration. The decoration is fitted with the hollow tube body which is cooperatively fitted around the exhaustion pipe without changing the original structure of the exhaustion pipe. The decoration can be replaced as desired by the user without affecting the exhaustion function.

The present invention can be best understood through the following description and accompanying drawings wherein:

DETAILED DESCRIPTION OF THE PREFERRED EMBODIMENT

Figure 1:
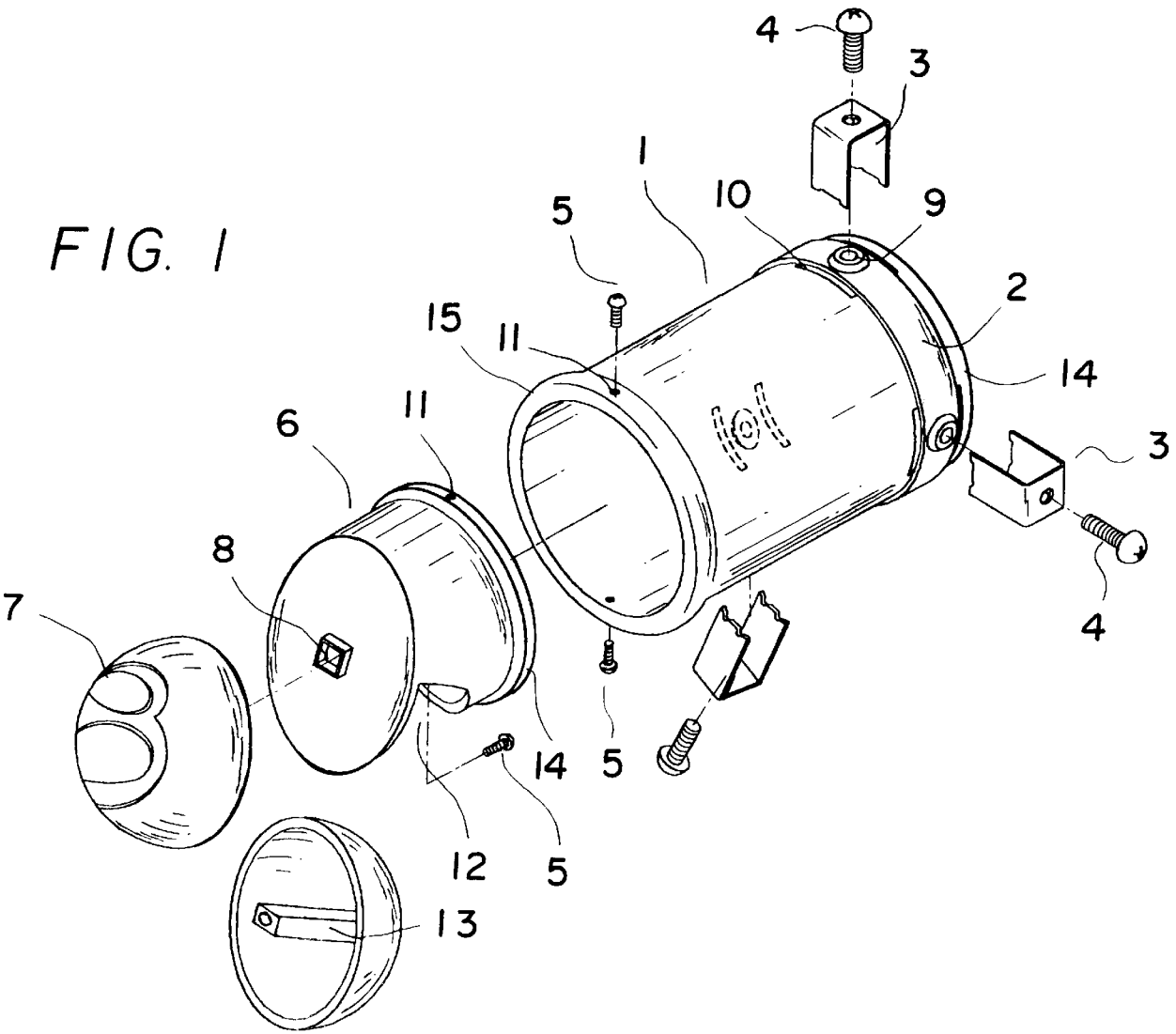
FIG. 1 is a perspective exploded view of the exhaustion pipe structure of the present invention.
Figure 2:
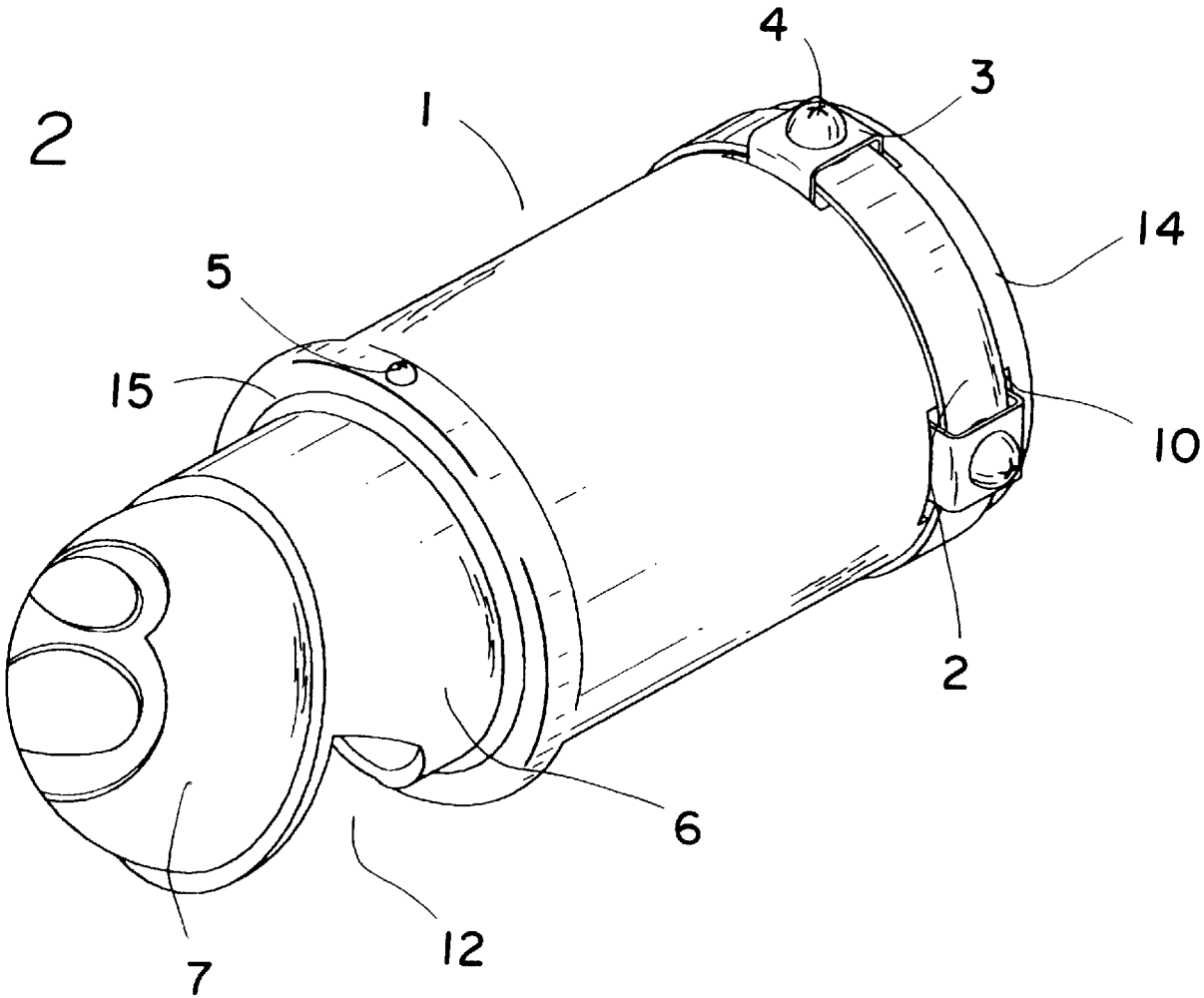
FIG. 2 is a perspective assembled view of the exhaustion pipe structure of the present invention.

Please refer to FIGS. 1 and 2. The present invention includes a hollow tube body 1, a fitting ring 2, locking plates 3, an exhaustion fitting pipe 6 and a decoration 7.

The hollow tube body 1 is fitted around the exhaustion pipe of the car. One end of the hollow tube body 1 is formed with several slits 10 at equal intervals for the locking plates 3 to pass therethrough. The other end thereof is formed with a flange 15 formed with opposite thread holes 11.

The fitting ring 2 is fitted around one end of the hollow tube body 1 and formed with three locking holes 9 at equal intervals for screws 4 to screw in.

The locking plate 3 is a U-shaped metal plate fitted through the slits 10 into the hollow tube body 1 and locked by the screw 4.

The exhaustion fitting pipe 6 is inserted into the hollow tube body 1. One end of the exhaustion pipe 6 is disposed with a fitting section 14 for fitting with the hollow tube body 1. The other end thereof is disposed with an oblique cut face. The center of the oblique cut face is formed with a rectangular insertion hole 8 for an inner pillar 13 of the decoration 7 to insert thereinto. One side of the exhaustion fitting pipe 6 is formed with an exhaustion port 12 for exhaustion of the gas.

The decoration 7 is replaceably fitted with the exhaustion fitting pipe 6 with the inner pillar 13 inserted into the insertion hole 8 of the oblique cut face of the exhaustion fitting pipe 6.

Figure 3:
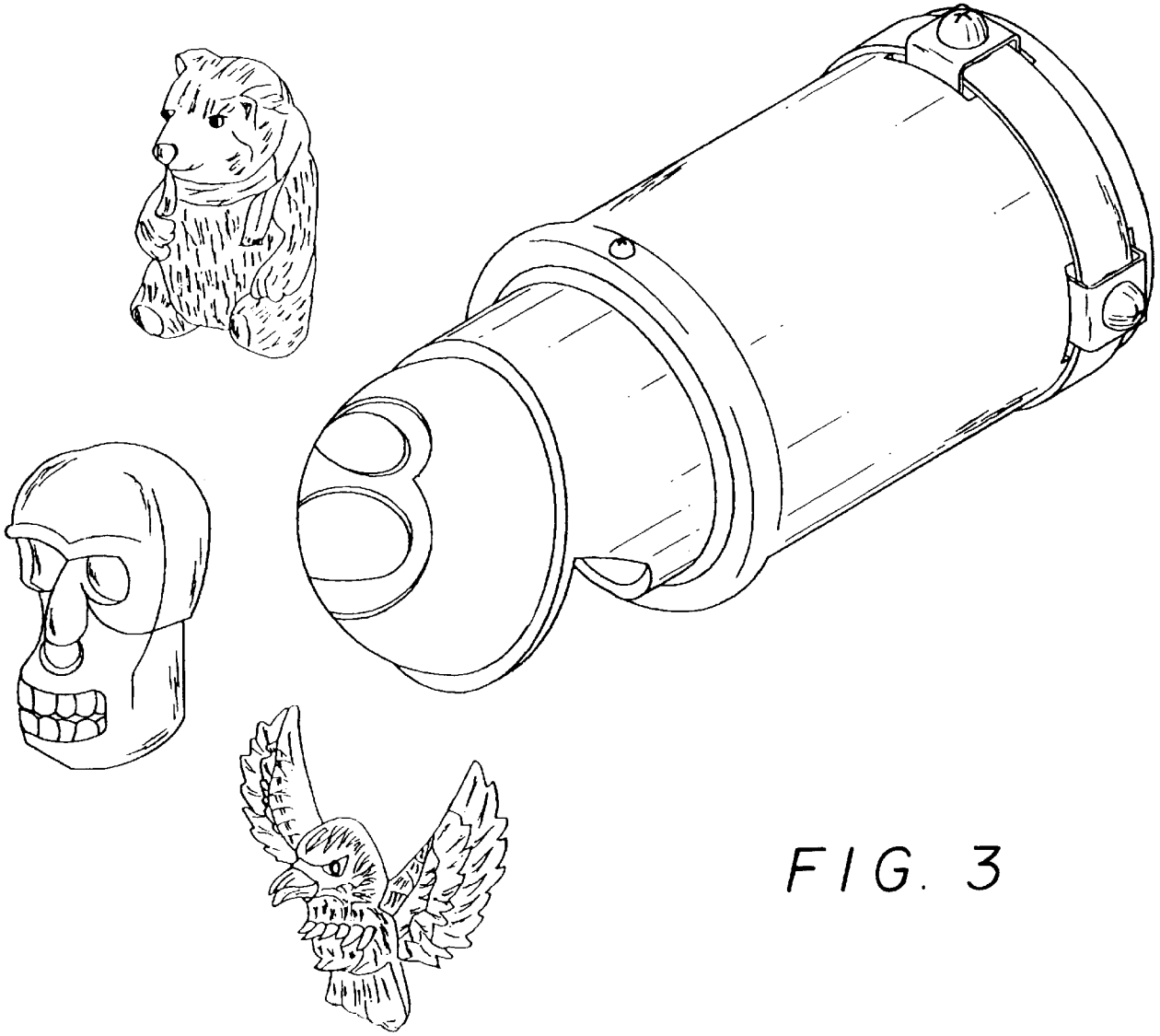
FIG. 3 is a perspective view showing the application of the exhaustion pipe structure of the present invention.

Referring to FIG. 3, the decoration 7 can have various patterns and is replaceably fitted with the exhaustion pipe to achieve a beautified appearance.

When assembled, the exhaustion fitting pipe 6 is first inserted into the hollow tube body 1 and locked therewith by screws 5. Then, the inner pillar 13 of the decoration 7 is inserted into the insertion hole 8 of the oblique cut face and locked therewith by screw 5. Finally, the hollow tube body 1 is fitted around the exhaustion pipe of the car. The locking plate 3 is passed through the slits 10 and fitted into the hollow tube body 1 and locked with the exhaustion pipe of the car by screws 4.

The above embodiment is only used to illustrate the present invention, not intended to limit the scope thereof. Many modifications of the above embodiment can be made without departing from the spirit of the present invention.

What is claimed is:

1. An exhaustion pipe structure comprising a hollow tube body, a fitting ring, locking plates, an exhaustion fitting pipe and a decoration, wherein:

the hollow tube body is fitted around the exhaustion pipe of a car, one end of the hollow tube body being formed with several slits at equal intervals for the locking plates to pass therethrough, the other end thereof being formed with a flange formed with opposite thread holes;

the fitting ring is fitted around one end of the hollow tube body and formed with several locking holes at equal intervals for screws to screw in;

the locking plate is a U-shaped metal plate fitted through the slits into the hollow tube body and locked by the screw;

the exhaustion fitting pipe is inserted into the hollow tube body, one end of the exhaustion pipe being disposed with a fitting section for fitting with the hollow tube body, the other end thereof being disposed with an oblique cut face, a center of the oblique cut face being formed with a rectangular insertion hole for an inner pillar of the decoration to insert thereinto, one side of the exhaustion fitting pipe being formed with an exhaustion port for exhaustion of the gas; and the decoration is replaceably fitted with the exhaustion fitting pipe with the inner pillar inserted into the insertion hole of the oblique cut face of the exhaustion fitting pipe.

* * * * *